US006890274B2

(12) United States Patent
Carlton et al.

(10) Patent No.: US 6,890,274 B2
(45) Date of Patent: May 10, 2005

(54) SHUTTLECOCK

(76) Inventors: William Charles Carlton, Villa Tas-Silg, Delimara Road, Marsaxlokk, ZTN 09, Malta (GB); Sarah Jane Gauci Carlton, Villa Tas-Silg, Delimara Road, Marsaxlokk, ZTN 09, Malta (GB)

( * ) Notice: Subject to any disclaimer, the term of this patent is extended or adjusted under 35 U.S.C. 154(b) by 25 days.

(21) Appl. No.: 10/467,740

(22) PCT Filed: Feb. 12, 2001

(86) PCT No.: PCT/EP01/01536

§ 371 (c)(1),
(2), (4) Date: Sep. 4, 2003

(87) PCT Pub. No.: WO02/064220

PCT Pub. Date: Aug. 22, 2002

(65) Prior Publication Data

US 2004/0077442 A1 Apr. 22, 2004

(51) Int. Cl.[7] ..... A63B 67/18
(52) U.S. Cl. ..... 473/579
(58) Field of Search ..... 473/579, 580

(56) References Cited

U.S. PATENT DOCUMENTS

| | | | |
|---|---|---|---|
| 2,830,817 | A | 4/1958 | Schoberl |
| 5,853,340 | A | 12/1998 | Willis |

FOREIGN PATENT DOCUMENTS

| | | | |
|---|---|---|---|
| DE | 344938 | | 12/1921 |
| DE | 1076538 | B | 2/1960 |
| FR | 1115729 | A | 4/1956 |
| GB | 689532 | | 4/1953 |
| GB | 820179 | A | 9/1959 |
| GB | 907700 | | 10/1962 |
| GB | 1103364 | A | 2/1968 |
| GB | 2279580 | A | 1/1995 |
| GB | 2353482 | A | 2/2001 |

*Primary Examiner*—John A. Ricci
(74) *Attorney, Agent, or Firm*—Clifford W. Browning; Woodard, Emhardt, Moriarty, McNett & Henry LLP

(57) ABSTRACT

A shuttlecock having a cap and a flared skirt, the latter having an inner and outer part made of artificial material and incorporating in the outer part, a plurality of stems and ribs connecting the stems and flaps projecting from the edges of said ribs at a substantial angle to the outer face of the ribs and to the airflow passing along the normal line of flight of the shuttlecock. This increases the resistance of the outer skirt, and improves the turnover of the shuttlecock. The flaps project from at least the trailing edge of the ribs and may also project from the leading edge. The invention is developed so that a plurality of flutes are formed in the outer skirt, the said flaps project from the trailing edges of the ribs on the right face of the flutes. The flaps may also project from the leading edges of the ribs on the left face of the flutes. The combination of the angle of the flute and the angle of the flap causes the shuttlecock to spin rapidly. The flaps nest in the space between the flutes and the inner perimeter of the tube in which the shuttlecocks are packed.

7 Claims, 4 Drawing Sheets

SHUTTLECOCK

TECHNICAL FIELD

This specification is in the field of sports equipment and relates to shuttlecocks of the type which have a cap and a flared skirt made of artificial material. This flared skirt has an inner and an outer part and may incorporate a balloon in the space partially enclosed by the said flared skirt.

BACKGROUND ART

There are two main types of shuttlecocks, those in which the flared skirt is made of feathers and those in which the flared skirt is made of artificial material: the former spin more rapidly than the latter when propelled at the same speed. Slow spin has been induced in shuttlecocks having a skirt of artificial material by introducing into the plane of the outer skirt deflectors such as flutes made by indenting the ribs, setting the stems at an angle to the line of flight, and similar features. Examples of specifications which have given attention to these features are GB 689532, GB907700 and D 344938. Diagrammatic sketches of well-known models from the period 1960 to 1998 are given in FIGS. 1–5 of this specification: FIG. 1 on sale by Carlton, 1960. FIG. 2 on sale by Dunlop Carlton, 1997. FIG. 3 on sale by Yonex, 1998. FIG. 4 on sale by R. J. Classic, 1998. FIG. 5 on sale by Yonex, 1998. All of these shuttlecocks incorporate flutes which are arranged in substantially the same manner as that shown in FIG. 6 and all the ribs are arranged between the stems. Projections from the outermost rib have their outermost part above the stems. Shuttlecocks having ribs between the stems but no flutes were on sale by Carlton in 1951.

Technical Problems to be Overcome

There are two problems which are associated. The first is the turnover, which is defined for the purpose of this specification as resistance to tumbling, cap over skirt, when the direction of flight is changed in play. A good turnover is aided by increasing the flare, increasing the resistance and/or reducing the weight of the outer part of the skirt. The second problem is that Law 3.1 of badminton includes the requirement that the correct speed of a shuttle is ascertained by striking a shuttle with a full underhand stroke but Law 2.1 requires that the flight characteristics should be similar to those produced by a natural feathered shuttle; these two laws are to some extent, conflicting. A full underhand stroke strikes the shuttlecock with much less force than a severe smash but a good feather shuttlecock moves quickly when smashed and decelerates rapidly immediately after the smash. This deceleration is affected by the speed of the spin of the feather shuttlecock, which is caused by the passage of air between the overlapping parts of the feathers. The technical problem is to improve the turnover and at the same time, increase the speed of the spin of a shuttlecock having a skirt made of artificial material.

DISCLOSURE OF INVENTION

This invention is that in a shuttlecock having a cap and a flared skirt, the said flared skirt incorporating an inner and outer part made of artificial materials, said flared skirt incorporating in its outer part a plurality of stems and a plurality of ribs connecting said stems and in that the said outer part incorporates a plurality of flaps which project from the edges of said ribs at a substantial angle to the outer face of said ribs and to the airflow passing along the flared skirt of the shuttlecock.

The invention is developed in that the said flaps project from the trailing edge of the said ribs Another development is that the said flaps project from the leading edge of said ribs. A further development is that the said shuttlecock incorporates a plurality of flutes in the said outer skirt, the said flutes incorporating two faces referred to as the left face and the right face and in that said flaps project from the trailing edge of the ribs on the said right faces of the said flutes. A further development is that a plurality of flaps project from the edges of a plurality of ribs, the said flaps being on the same side of the same flute. The invention is further developed in that the said flaps project from the leading edge of the said left faces on the said flutes. The invention may be alternatively developed in that the said flaps project from the trailing edge on the left faces on the said flutes.

Advantageous Effects

By setting the flaps associated with the ribs at a substantial angle to the outer face of said ribs and to the airflow passing along the flared skirt of the shuttlecock the resistance of the outer skirt is increased, and the combination of the angle of the flap and the angle of the appropriate face of the flute improves the turnover and increases the speed of the spin at the same time. Further, the outer part of the flap is substantially within the perimeter of the tube into which the shuttlecock is packed, and is therefore protected whilst in storage; this is a critical advantage.

MODES OF CARRYING OUT THE INVENTION

The invention will now be described by way of example and with reference to certain of the following accompanying drawings in which.

Figure 1:
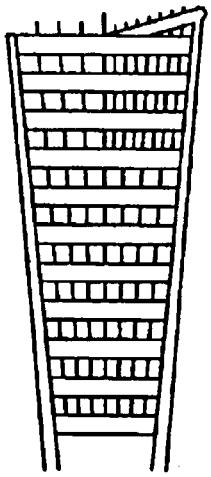
FIG.1 (PRIOR ART)
FIGS. 1–6 are examples of the background art.
Figure 2:
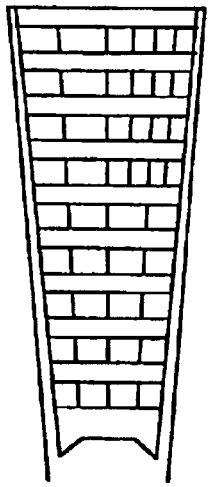
FIG.2 (PRIOR ART)
Figure 3:
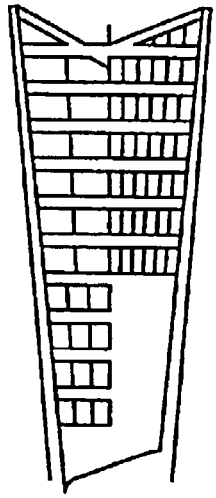
FIG.3 (PRIOR ART)
Figure 4:
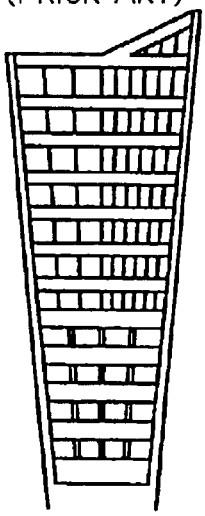
FIG.4 (PRIOR ART)
Figure 5:
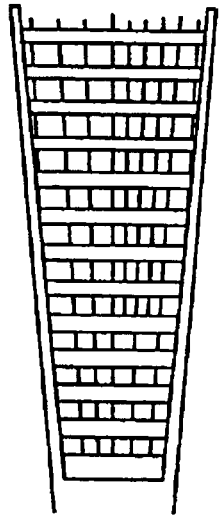
FIG.5 (PRIOR ART)
Figure 6:
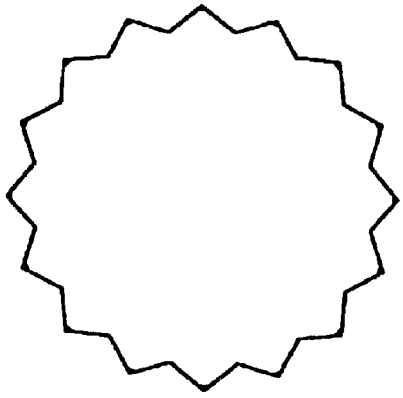
FIG.6 (PRIOR ART)
Figure 7:
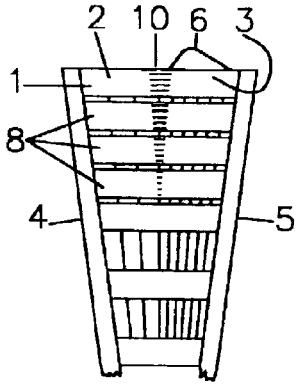
FIG. 7 is a diagrammatic view of the front elevation of one panel of a plurality of panels in the outer skirt of a shuttlecock incorporating the invention.
Figure 8:
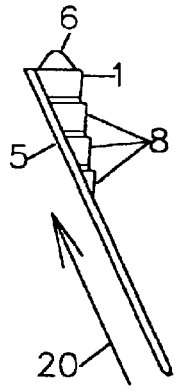
FIG. 8 is a side elevation of the panel of FIG. 7, showing a stem and a plurality of ribs in one side of the flute.
Figure 9:
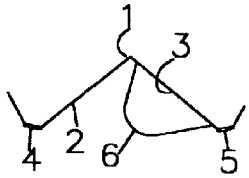
FIG. 9 is a diagrammatic view from the rear of the trailing edge of one rib in which a flute has been formed in the shuttlecock.
Figure 10:
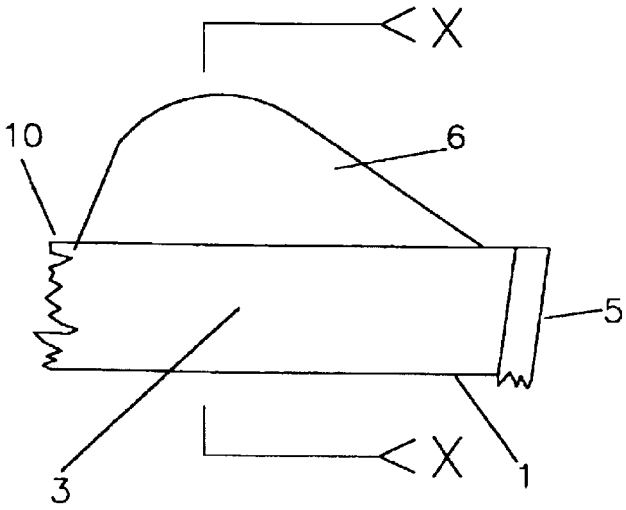
FIG. 10 is a much enlarged diagrammatic view of the rib 1 with its flap 6.
Figure 11:
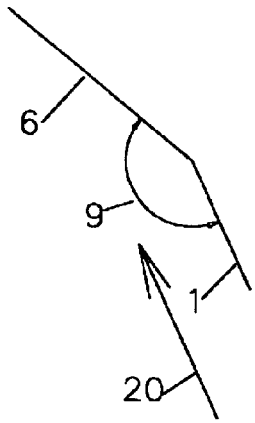
FIG. 11 is a diagrammatic view of a section through XX in FIG. 10.

Referring now to FIGS. 7, 8, 9, 10 and 11 the rib 1 connecting stems 4 and 5 is indented to form a flute having a left face 2 and a right face 3. The flap 6 projects from the trailing edge 10 of the rib 1 at a substantial angle 9 (about 120°) to the outer surface of the rib 1 and to the airflow passing along the flared skirt indicated by the direction of the stem 5 in relation to the arrow 20 in FIG. 8. This flap 6 not only increases the flare but also increases the resistance of the outer skirt. Because it is a convention that a shuttlecock rotates in an anti-clockwise direction when viewed from the rear, in the above example the flap 6 is on the right face 3 of the flute 2–3, which is formed by indenting the rib 1, which itself connects the stems 4 and 5. If it was required that the shuttlecock should rotate in the opposite direction, the system would be reversed. Further ribs 8 also connect the stems 4 and 5. The combination of the angle of the right face 3 of the flute with the angle of the flap 6 causes the shuttlecock to spin rapidly in an anti-clockwise direction when viewed from the rear. The 'substantial' angle 9 is not critical.

Figure 12:
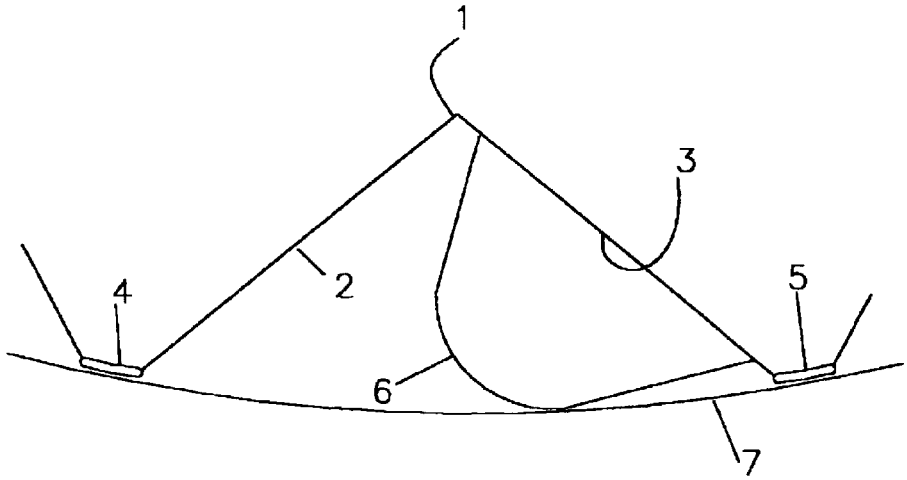
FIG. 12 is an enlarged rear view of the rib 1 with its flap 6 as it would fit into a tube in which the shuttlecock is packed.

Referring now to FIG. 12, a much enlarged view of a flute of a shuttlecock when positioned in a packing tube; the inside edge of the packing tube 7 encloses the stems 4 and 5 and the rib 1, which is formed into a flute having a left face 2 and a right face 3. The flap 6 is substantially protected from deformation because it is protected by the space left between the flute 2–3 and the wall of the storage tube 7.

Figure 13:
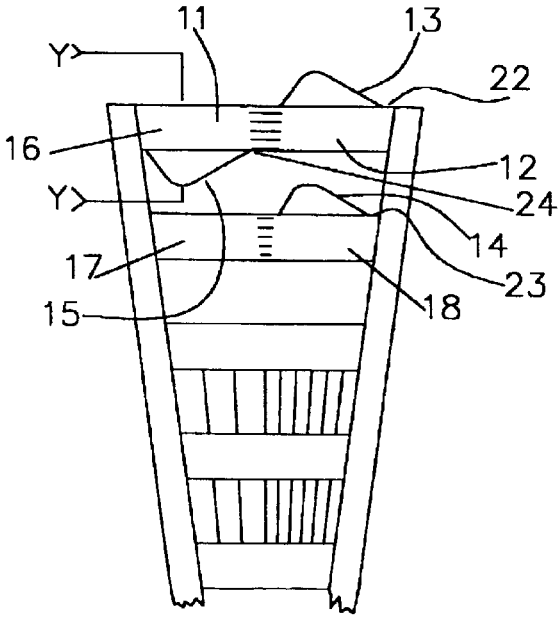
FIG. 13 is a view of a panel similar to that shown in FIG. 7, but with flaps in alternative positions.
Figure 14:
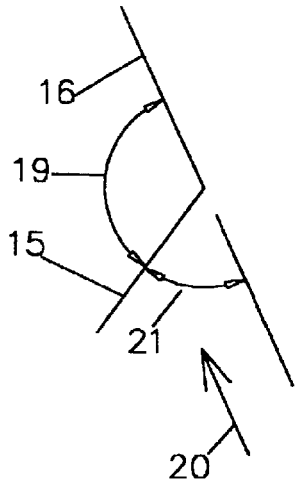
FIG. 14 is a diagrammatic enlarged view of a section through YY in FIG. 13.

Referring now to FIGS. 13 and 14, an enlarged view of a panel of a shuttlecock shows the arrangement of two ribs 16 and 17. Rib 16 has a flap 13 projecting from the trailing edge 22 on the right face 12 of the flute 11–12, whilst rib 17 has a flap 14 projecting from the trailing edge 23 on the right face 18 of the same flute 11–12 making a plurality of flaps on the same face of one flute. Further, rib 16 has a flap 15 projecting from its leading edge 24 on the left face 11 of the flute 11–12. For the sake of clarity, all ribs in one panel are considered to be in the same flute.

Referring to FIG. 14, a diagrammatic view of a section through YY in FIG. 13, the flap 15 projects at a substantial angle 19 (about 120°) from the leading edge of rib 16; the said flap 15 is also projecting at a substantial angle 21 (about 60°) to the airflow indicated by the arrow 20, passing along the flared skirt. The 'substantial' angles 19 and 21 are not critical.

In the above examples there is a slight difference between the angle of the outer face of the ribs and the general angle of the flared skirt but the difference is not material to the efficiency of this invention.

Figure 15:
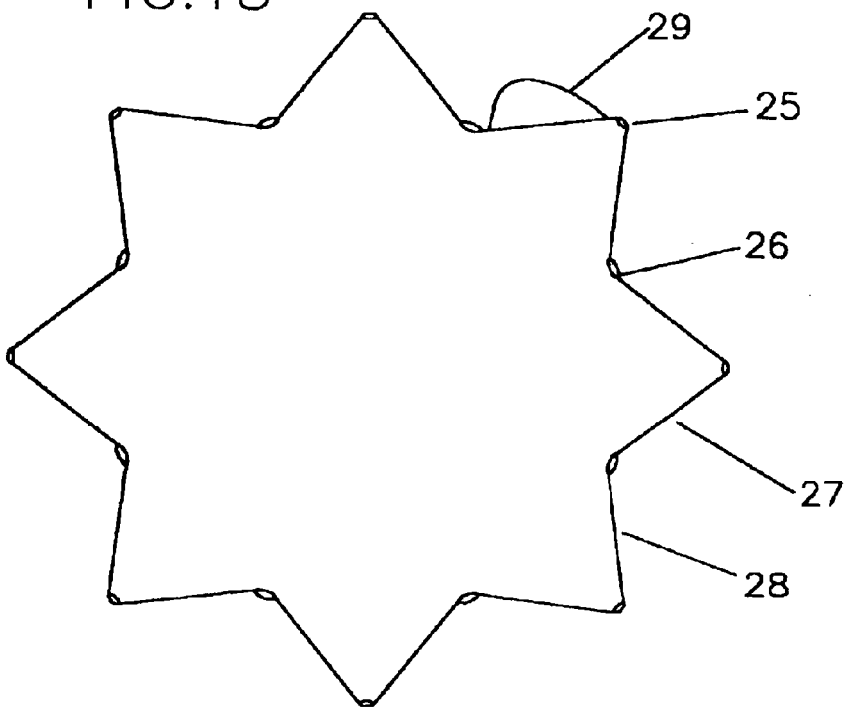
FIG. 15 is a diagrammatic rear view of the flutes of a shuttlecock with an alternative arrangement of the stems and ribs.
Figure 16:
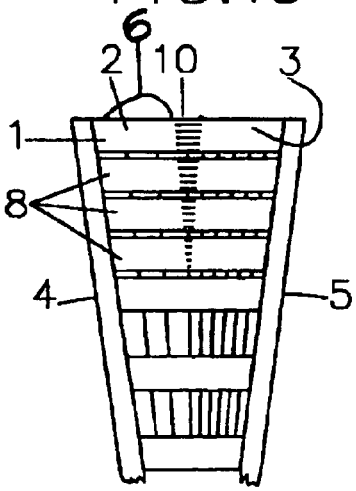
FIG. 16 is a diagrammatic view of the front elevation of one panel of an alternate embodiment.
Figure 17:
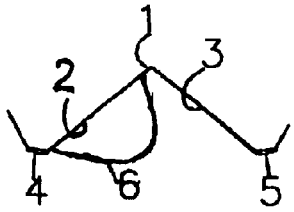
FIG. 17 is a diagrammatic view from the rear of the trailing edge of an alternate embodiment of one rib in which a flute has been formed in the shuttlecock.

Referring to FIG. 15, a rear view of an alternative construction of a shuttlecock; there is a plurality of stems 25 on a larger diameter than a plurality of stems 26. This allows larger flutes with no indentation of the ribs 27 and ribs 28 but larger flaps 29 could then be employed.

Referring again to FIGS. 7, 9, 10 and 12, the highest part of the flap 6 is between the stems 4 and 5.

What is claimed is:

1. In a shuttlecock having a cap and a flared skirt, the said flared skirt incorporating an inner and an outer part made of artificial materials, said flared skirt incorporating in its outer part a plurality of stems (4,5), extending in the direction of the airflow (20), passing along the said flared skirt in the normal line of flight of the shuttlecock, and a plurality of ribs (1,8,16,17) connecting said stems, the shuttlecock being characterized in that the said outer skirt incorporates a plurality of flaps (6,13, 14,15) which project from edges of said ribs (1,8,16,17) at a substantial angle (9,19,28) to the outer face of the said ribs (1,8,16,17) and to the airflow (20).

2. A shuttlecock as in claim 1 and characterized in that the said flaps (6,13,14,) project from the trailing edge (10,22,23) of the said ribs (1,16,17).

3. A shuttlecock as in claim 1 and characterized in that the said flaps (15) project from the leading edge (24) of the said ribs (16).

4. A shuttlecock as in claim 1 or 2 incorporating a plurality of flutes (2–3, 11–12) in the said outer part, the faces of the said flutes being referred to as the left face (2,11) and the right face (3,12) when viewed from the rear of the shuttlecock, and the shuttlecock being characterized in that the said flaps (6,13,14) project from the trailing edge (10, 22,23) of the ribs (1,16,17) on the right face (3,12,18) of the said flutes (2–3, 11–12).

5. A shuttlecock as in claim 1 or 3 incorporating a plurality of flutes (11–12) the faces of which are referred to as the left face (11) and the right face (12) when viewed from the rear of the shuttlecock and the shuttlecock being characterized in that the said flaps (15) project from the leading edges (24) of the ribs (16) on the left faces (11) of the flutes (11–12).

6. A shuttlecock as in claim 1 incorporating a plurality of flutes (2,3) the faces of which are referred to as the left face (2) and the right face (3) when viewed from the rear of the shuttlecock, the shuttlecock being further characterized in that the said flaps (6) project from the trailing edge (10,22) of the said ribs (1,16) on the left face (2,11) of the flutes (2–3, 11–12).

7. A shuttlecock as in claim 1 and characterized in that the highest part of each of said flaps is between the stems (4) and (5).

* * * * *